United States Patent [19]

Ruschepaul

[11] 4,275,878

[45] Jun. 30, 1981

[54] DEVICE FOR SEPARATING SHEETS

[75] Inventor: Klaus-Jörg Ruschepaul, Hattersheim, Fed. Rep. of Germany

[73] Assignee: Hoechst Aktiengesellschaft, Frankfurt am Main, Fed. Rep. of Germany

[21] Appl. No.: 84,547

[22] Filed: Oct. 15, 1979

[30] Foreign Application Priority Data

Oct. 21, 1978 [DE] Fed. Rep. of Germany ..... 2845962

[51] Int. Cl.[3] ..... B65H 3/56

[52] U.S. Cl. ..... 271/170; 271/171

[58] Field of Search ..... 271/117, 170, 171, 223

[56] References Cited

U.S. PATENT DOCUMENTS

| | | | |
|---|---|---|---|
| 3,029,074 | 4/1962 | Springer | 271/170 |
| 3,301,551 | 1/1967 | Cassano et al. | 271/170 X |
| 3,539,178 | 11/1970 | Yanagawa | 271/170 X |
| 3,574,348 | 4/1971 | Kaneko | 271/170 |
| 3,601,389 | 8/1971 | Kramer . | |
| 3,807,725 | 4/1974 | Bookless | 271/170 X |

FOREIGN PATENT DOCUMENTS

| | | |
|---|---|---|
| 2007594 | 3/1970 | Fed. Rep. of Germany . |
| 2265108 | 4/1976 | Fed. Rep. of Germany . |
| 2211494 | 3/1978 | Fed. Rep. of Germany . |
| 2643388 | 7/1978 | Fed. Rep. of Germany . |

*Primary Examiner*—Robert W. Saifer

*Attorney, Agent, or Firm*—Schwartz, Jeffery, Schwaab, Mack, Blumenthal & Koch

[57] ABSTRACT

Disclosed is a device for separating sheets from a stack of sheets, comprising a base for supporting the stack of sheets; a bar extending transversely along one edge of the stack of sheets; two members attached to the bar at a distance from one another corresponding to the width of the sheets for holding down the corners of the sheets; and two guide elements mounted on the base on opposing sides of the stack of sheets for vertically displaceably receiving the bar and guiding the bar along a vertical path.

10 Claims, 3 Drawing Figures

2
8
9
10
11
12
13
14
A4
A3

DEVICE FOR SEPARATING SHEETS

BACKGROUND OF THE INVENTION

The present invention relates to a device for separating single sheets from a stack of sheets, and more especially to such a device which includes vertically displaceable corner hold-down members in the area of the front corners of the sheets.

German Auslegeschrift No. 2,643,388 discloses a sheet separating device equipped with nearly vertically displaceable corner hold-down members in the area of the front corners of the sheets, each of the hold-down members being attached to one end of a lever which is adapted to be pivoted about a first swivel joint provided at its opposite end, with the two levers being arranged along the two longitudinal sides of the stack of sheets. The lever is also hinged on a second movable swivel joint which forms a part of the lever. On this second swivel joint a control bar having a fixed swivel joint is pivoted. The first swivel joint is displaceably arranged.

This device, in which the corner hold-down members are fastened to pivotable levers, requires a certain expense to obtain a nearly straight-line travel of the corner hold-down members in the area of the front edge of the stack of sheets. For that purpose, a four-membered gear arrangement is necessary and, in addition, the corner hold-down members must be pivoted. In a separating device of this kind, the height of the stack of sheets is limited, because a straight-line motion of the corner hold-down members can only be obtained over a particular vertical range.

In the sheet separating device described in German Offenlegungsschrift No. 2,007,594, the corner hold-down members, which are mounted on swivel arms extending along the outer surfaces of guide bars, execute a substantially vertical movement along a curved path. In order to align the front end of the stack to correspond to this curved path, a front stop device is provided which can be moved into and out of an upright position into contact with the stack. This stop device is equipped with a stop member which is arranged between the corner hold-down members, and the lower end of the stop member is, by appropriate means, firmly connected to a shaft which is rotatably mounted in jaws underneath the tray containing the stack.

This known device is expensive, because, in addition to the arms employed to swivel the corner hold-down members, a separate stop device is provided which must be rotatable about a shaft, in order to take into account the curved downwardly extending path of the corner hold-down members, so that even the lowermost sheets of the stack can be separated without difficulty.

A sheet separating device which is disclosed in German Offenlegungsschrift No. 2,265,108 comprises control means which cause the corner hold-down members to be in substantially constant contact with the corners of the stack, so as to move along a vertically downward path during the separating process. For that purpose, a lever is attached to a side plate which has curved slots for receiving pegs protruding from the lever. When the lever is lifted, the pegs will follow the elongate, curved contour of the slots, whereby the sheet separating member moves substantially vertically downwardly. A cam system is provided for lifting the lever.

This sheet separating device also comprises relatively expensive elements which are necessary to move the corner hold-down members along an approximately vertical path.

In all of the above-described, previously proposed sheet separating devices the height of the stack of sheets is limited, because a straight-line motion of the corner hold-down members can only be achieved over a particular narrow range, and in this regard, additional means must be provided to move the corner hold-down members along a path which extends nearly vertically.

SUMMARY OF THE INVENTION

It is therefore an object of the present invention to provide an improved device for separating single sheets from a stack of sheets.

It is another object of the present invention to provide a sheet separating device which is constructed in an uncomplicated and inexpensive manner.

Another object of the invention is to provide a sheet separating device which enables a precise vertical motion of the corner hold-down members over the entire height of the stack without the use of additional means.

Still another object of the invention resides in the provision of a sheet separating device in which the height of the stack of sheets is only limited by the overall height of the sheet stacking device and not by the particular range over which a straight-line motion of the corner hold-down members can be attained.

In accomplishing the foregoing objects, there has been provided in accordance with the present invention a device for separating single sheets from a stack of sheets, comprising a base for supporting the stack of sheets; a bar extending transversely along one edge of the stack of sheets; two members attached to the bar at a distance from one another corresponding to the width of the sheets for holding down the corners of the sheets; and two guide elements mounted on the base on opposing sides of the stack of sheets for vertically displaceably receiving the bar and guiding the bar along a vertical path. Preferably, the two guide elements comprise cylindrical members provided with vertical guide slots which extend parallel to the cylinder axis for receiving and slidingly guiding the ends of the bar.

Further objects, features and advantages of the present invention will become apparent from the detailed description of preferred embodiments which follows, when considered together with the attached figures of drawing.

DETAILED DESCRIPTION OF PREFERRED EMBODIMENTS

According to the invention there is provided a device comprising two corner hold-down members and a bar which is vertically displaceable in guide elements. The invention yields the advantages that the constructional xpense is considerably reduced as compared with preiously proposed sheet separating devices, that an unmited height of the stack of sheets is rendered possible, ıd that complicated adjusting operations are not reuired when the sheet size is changed. Instead, it is only ecessary to exchange the bar or to move one or both orner hold-down members from the positions of the riginal sheet size to the positions for the new sheet size, hich are provided on the bar.

Below, three illustrated embodiments of the invenon will be explained in more detail, with reference to ıe drawings.

Figure 1:
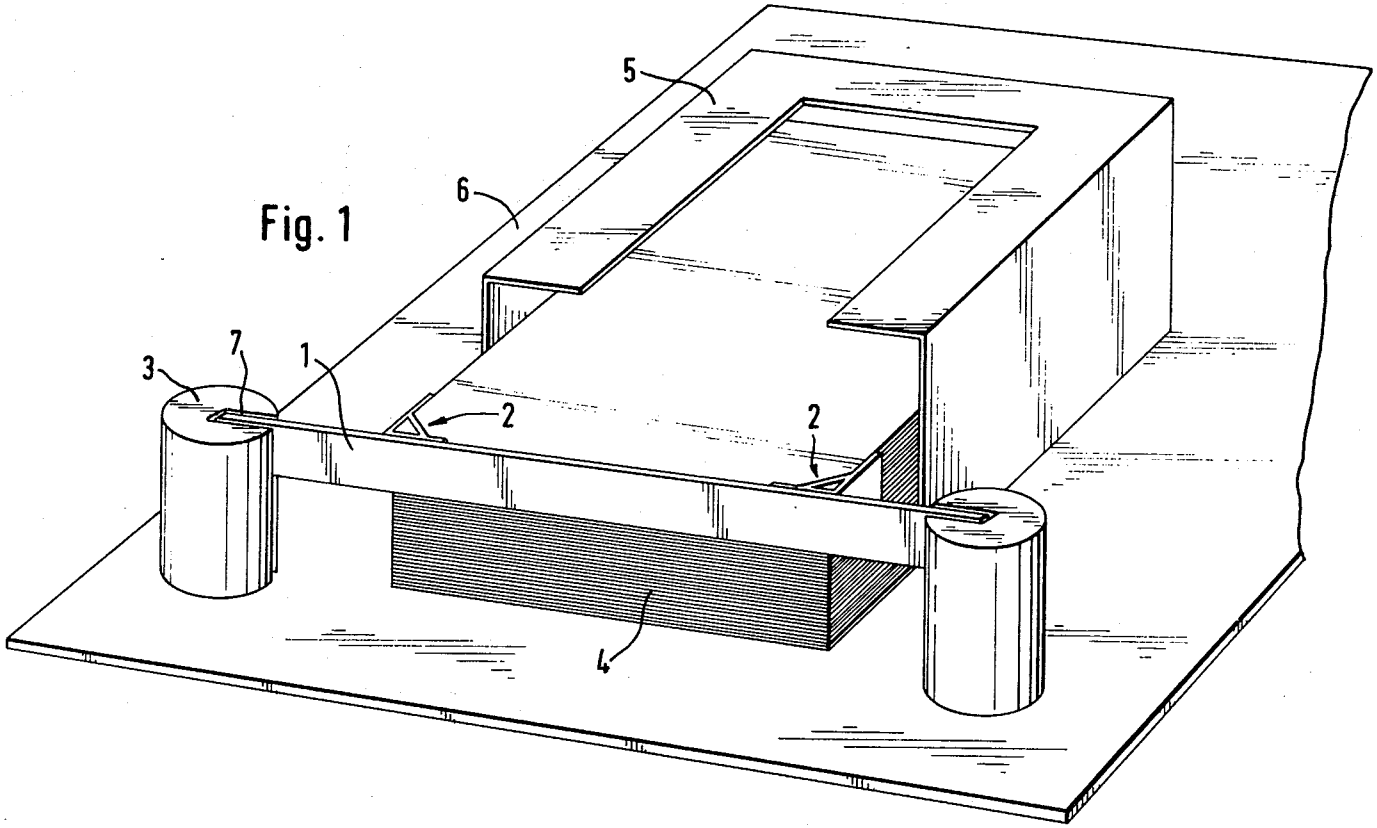
FIG. 1 is a diagrammatic perspective view of the sheet separating device according to the invention comprising a bar to which the corner hold-down members are non-detachably fastened.

The sheet separating device represented in FIG. 1 is omprised of a bar 1 carrying two corner hold-down embers 2 and of two guide elements 3 arranged on a ıse plate 6 accommodating a stack of sheets 4. The ıide elements 3 have the shape of cylinders, and each ylinder has a vertical guide slot 7 which extends paral-l to the cylinder axis and receives and slidingly guides ıe ends of the bar 1. At its ends, the bar 1 is formed in ıch a way that it is capable of sliding almost frictionssly within the guide slots 7, and it is, for example, ade of metal so that, on account of its weight, it exerts ıfficient pressure upon the corner hold-down members for holding down the sheets in the stack. In the emodiment according to FIG. 1, the corner hold-down embers 2 are firmly, i.e., non-detachably, fastened to e bar 1. The distance between the two corner holdown members 2 corresponds to the width or length of given sheet size.

Each corner hold-down member 2 (FIG. 2a) comises an angular separating corner made up of two ıgle sides 12 and 13. At the upper side of the separating orner a diagonal brace 9 is provided which extends tween the angle sides and has its top edge flush with e top edges of the angle sides 12 and 13. Instead of the agonal brace 9, a triangular piece 8 (FIG. 2b) may be ovided which closes the butting corner of the two ıgle sides 12 and 13 at the top side.

Before the stack of sheets 4 is placed upon the base ate 6, the bar 1 is removed from the guide elements 3. pon adjusting the stack of sheets 4, which is, for exame, placed upon the base plate 6 together with its packe 5, the bar 1 is introduced at its ends into the guide ots 7. On account of its own weight, it rests upon the permost sheet in the stack 4 by way of the corner ld-down members 2. The bar 1, including the corner ld-down members 2, may be designed as an integral rt. If the sheet size is changed, the bar 1 originally ed must then be exchanged for another bar 1 in which e distance between the corner hold-down members 2 rresponds to the new sheet size.

It need not be explained in detail that the decreasing ight of the stack of sheets 4 causes the bar 1 to deend perpendicularly toward the base plate 6, since the rtical guide slots 7 in the guide members 3 will permit perpendicular motion only.

Figures 2A, 2B:
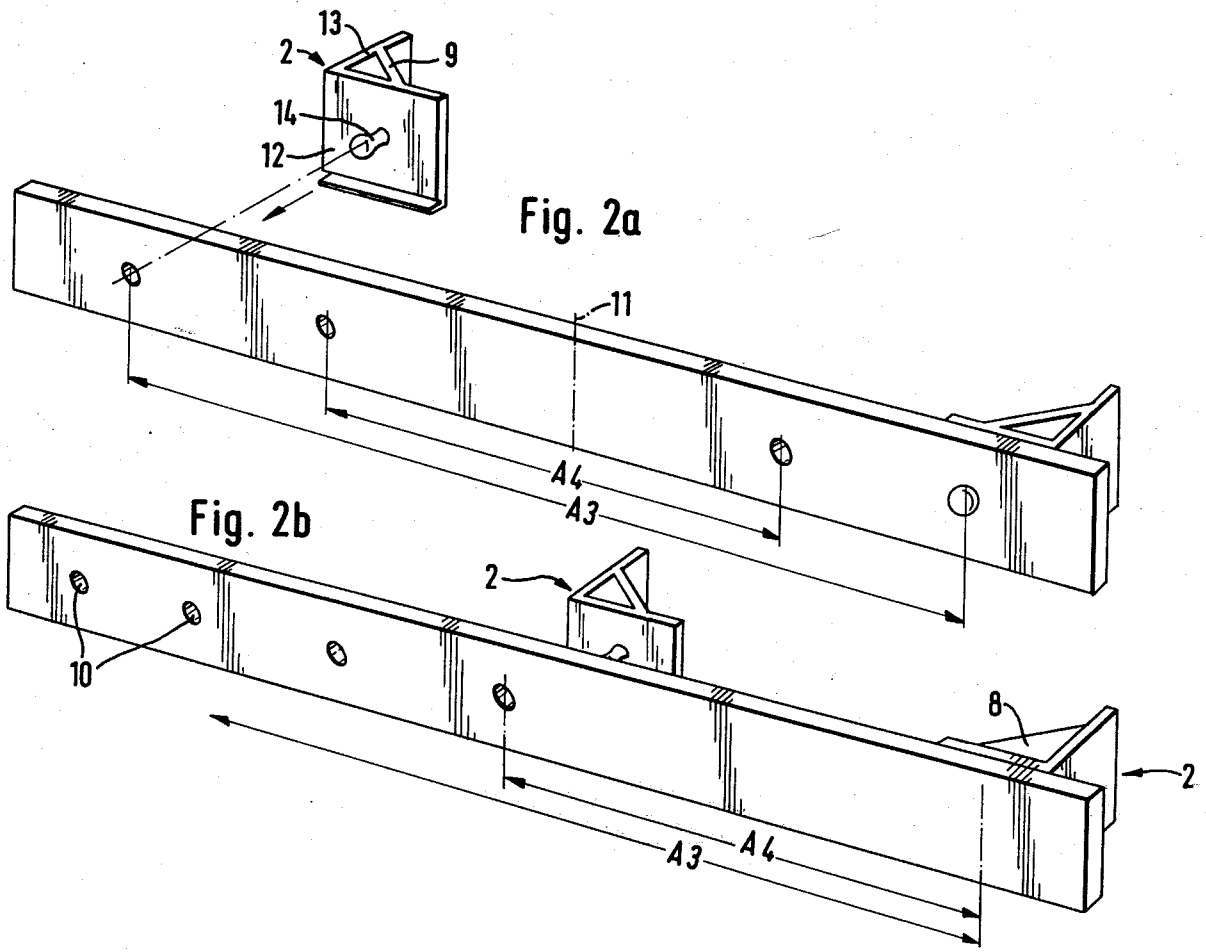
FIG. 2*a* is an exploded perspective view of a bar of the sheet separating device showing a corner hold-down member detached from the bar.
FIG. 2*b* is a view similar to FIG. 2*a* illustrating another embodiment of a bar of the sheet separating device.

The bar 1 depicted in FIG. 2a has a number of holes which are distributed over the length of the bar mmetrically with respect to the center line 11 thereof, predetermined distances from one another, so as to m pairs. The distances between the pairs of holes 10 rrespond, for example, to the DIN A4 and DIN A3 es. The holes 10 may naturally also have different tances from one another, which correspond to other N sizes or internationally used sizes, for example, the an B size or U.S. or British sizes.

In this embodiment of the bar 1, at least one of the corner hold-down members 2 is detachably mounted. For this purpose, the corner hold-down member 2 has a pin 14 on the outer surface of one of the angle sides 12 or 13, which can be inserted into one of the holes 10 in the bar 1. It is also possible to mount both corner hold-down members detachably on the bar. FIG. 2a shows the corner hold-down member 2 on the left detached from the bar 1, while the corner hold-down member 2 on the right is inserted into the bar 1.

In the embodiment according to FIG. 2b, the corner hold-down member 2 on the right is firmly fastened to the bar 1, while the corner hold-down member 2 on the left is detachably mounted thereon. By this arrangement, the number of holes 10 in the bar can be reduced by half, in comparison to the number of holes in the embodiment according to FIG. 2a. In order to prevent a tilting of the bar 1 within the guide slots 7, it must only be taken into account in this embodiment that, compared with the corner hold-down members 2, the bar 1 has a considerably higher weight.

In the bars 1 according to FIGS. 2a and 2b, only one corner hold-down member or both corner hold-down members are moved to another position on the bar when the sheet size is changed.

What is claimed is:

1. A device for separating sheets from a stack of sheets, comprising:

a base for supporting the stack of sheets;

a bar extending transversely along one edge of the stack of sheets;

two members attached to said bar at a distance from one another corresponding to the width of the sheets for holding down the corners of the sheets;

two guide elements mounted on said base on opposing sides of the stack of sheets for vertically displaceably receiving said bar and guiding said bar along a vertical path; and wherein each of said corner hold-down members comprises two angle sides forming an angular separating corner and a diagonal brace extending transversely to the angle sides.

2. A device as claimed in claim 1, wherein said bar is guided at each of its two ends in said guide element.

3. A device as claimed in claim 1, wherein said two guide elements comprise cylindrical members provided with vertical guide slots which extend parallel to the cylinder axis for receiving and slidingly guiding the ends of said bar.

4. A device as claimed in claim 1, wherein each of said corner hold-down members is non-detachably fixed to said bar.

5. A device as claimed in claim 1, wherein at least one of said corner hold-down members is detachably mounted on said bar.

6. A device as claimed in claim 5, wherein said bar includes a plurality of holes spaced along its length and said detachably mounted hold-down member comprises a pin on the outer surface of one of the angle sides for insertion into one of the holes in said bar.

7. A device as claimed in claim 6, wherein the holes are arranged over the length of said bar symmetrically with respect to the center thereof, at predetermined distances from one another, so as to form pairs.

8. A device as claimed in claim 6, wherein one of said corner hold-down members is non-detachably fixed to said bar and the other of said corner hold-down members is detachably mounted on said bar, and wherein the holes are arranged at given distances from the inside of one of the angle sides of the stationary corner hold-down member, said given distances corresponding to various predetermined sheet sizes.

9. A device as claimed in claim 1, wherein said diagonal brace of at least one of said corner hold-down members comprises a triangular corner piece closing the butting corner of said angle sides at the top side thereof.

10. A device as claimed in claim 1, further comprising means for adjusting the distance between said corner hold-down members.

* * * * *